US010408591B1

(12) United States Patent
Manley et al.

(10) Patent No.: US 10,408,591 B1
(45) Date of Patent: Sep. 10, 2019

(54) STACKABLE KINETIC ENERGY RING CARTRIDGE

(71) Applicant: U.S. Government as Represented by the Secretary of the Army, Picatinny Arsenal, Dover, NJ (US)

(72) Inventors: David Chalfant Manley, Hackettstown, NJ (US); Thomas Michael Presutti, Jr., Long Valley, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/695,160

(22) Filed: Sep. 5, 2017

Related U.S. Application Data

(60) Provisional application No. 62/444,958, filed on Jan. 11, 2017.

(51) Int. Cl.
*F42B 14/06* (2006.01)
*F42B 10/36* (2006.01)
*F42B 5/03* (2006.01)

(52) U.S. Cl.
CPC ..... *F42B 14/065* (2013.01); *F42B 5/03* (2013.01); *F42B 10/36* (2013.01)

(58) Field of Classification Search
CPC .. F42B 5/02; F42B 5/045; F42B 10/36; F42B 14/06; F42B 14/064; F42B 14/065; F42B 5/03; F42B 5/035
USPC ..... 102/502, 503, 520, 521, 522, 523
See application file for complete search history.

(56) References Cited

U.S. PATENT DOCUMENTS 3,877,383 A * 4/1975 Flatau ..... F42B 10/36 102/503
3,919,799 A * 11/1975 Austin, Jr. ..... F41C 27/06 42/105
3,982,489 A * 9/1976 Flatau ..... F42B 10/36 102/502
4,154,012 A * 5/1979 Miller ..... F41C 27/06 102/483
4,212,244 A * 7/1980 Flatau ..... F42B 5/03 102/438
4,590,862 A * 5/1986 Grabarek ..... F42B 14/064 102/522
8,511,232 B2 * 8/2013 Scarr ..... F42B 5/03 102/502

* cited by examiner

*Primary Examiner* — James S Bergin
(74) *Attorney, Agent, or Firm* — Michael C. Sachs

(57) ABSTRACT

A projectile which can be used to defeat an unmanned aerial system. The projectile features sabots which do not impart any forward impedance to the sub-projectiles, and carries a payload of stacked rings enclosed in the projectile. The rings are backed by a support ring, and abut a pusher aft section. The projectile's sabots discard cleanly upon muzzle exit, releasing the ring sub-projectiles to cover a large area, thereby increasing the probability of impacting the target. The rings create large holes in the target, despite comparatively low mass of a given ring as a defeat element, allowing for multiple sub-projectiles to be fired with a single shot, thereby creating the effect of firing multiple projectiles with a single shot.

11 Claims, 4 Drawing Sheets

STACKABLE KINETIC ENERGY RING CARTRIDGE

CROSS REFERENCE TO RELATED APPLICATIONS

This application claims benefit under 35 USC § 119 (e) from provisional application 62/444,958 filed Jan. 11, 2017, the entire file wrapper contents of which are hereby incorporated by reference as though fully set forth.

U.S. GOVERNMENT INTEREST

The inventions described herein may be made, used, or licensed by or for the U.S. Government for U.S. Government purposes.

BACKGROUND OF INVENTION

An object of this invention is to provide a counter unmanned aerial system (CUAS) kinetic defeat solution. Unmanned aerial systems (UAS) are very robust in nature and as a result they are difficult to defeat. In order to increase the probability of defeating a UAS it is important to be able to damage a large area of the UAS, to increase the probability of causing sufficient structural damage to cause the UAS to be unable to complete its mission. In addition, impacting a large area of the UAS increases the opportunity to damage critical components of the UAS such as wires, batteries, motors, rotors, and other components. In addition to being able to damage large portions of the UAS, being able to increase the probability of hitting the target is important due to the fact that UAS targets are often small moving targets. As a result, it is also important to have multiple sub projectiles in the defeat mechanism to increase the probability of hitting the UAS. This invention comprises a cartridge which features stacked ring sub projectiles any one of which or all of which are capable of causing a large amount of damage to a UAS.

BRIEF DESCRIPTION OF THE INVENTION

The invention employs a projectile having a plurality of sub projectiles being flat, planar, ring shaped objects (metallic, plastic, or other materials, or composites thereof) the striking by which increases a probability of hitting critical components in a UAS target. The striking sub projectile is also able to cause sufficient structural damage to the UAS to defeat it, due to the large diameter hole that the ring may create as it passes through the target. This ring sub projectile is designed for CUAS purposes and it is intended to cause maximum damage to a target with a minimal mass. Several such sub projectiles are stacked inside this projectile. The projectile features a capless, multi-piece sabot which is able to retain its payload and release a stack of such rings without any disturbance. Therefore, it is possible to cause damage to a UAS target similar to what several large projectiles would cumulatively produce with one shot. In effect this ring design has a similar cumulative capable effect as that of having shot multiple, 40 mm sized slugs, within one single shot. Also, since the sub projectile is a ring shape, the mass is minimized for the size hole it creates, which allows for more sub projectiles to be fired in each round while staying within the recoil limits. In addition, due to the ring design the sub projectile has a reduced amount of drag imparted to it as compared to a baton style projectile, so this ring sub projectile design allows for greater engagement distances compared to the baton style projectile. This sub projectile is a simple ring design intended to cause a large amount of damage to a UAS or other target, at closer ranges. During testing it was discovered that it is crucial for the rings to be released "cleanly" in order for them to fly in a stable manner. This entails releasing the rings as a stack without impeding the forward motion of the rings. As a result, a "capless" sabot was designed in order to release the stack of rings without thus disturbing them. The capless design also ensures that the forward motion of the rings is not impeded.

OBJECTS OF THE INVENTION

Accordingly, it is an object of the present invention to provide projectile means which can be used to defeat an unmanned aerial system.

Another object of the present invention is to provide a projectile which releases a payload of stacked rings from the projectile upon exiting the muzzle of the barrel so as to disperse to cover a large area in order to increase probability of hit.

It is a further object of the present invention to provide an uncapped projectile, which allows a payload of rings to dispense cleanly as a stack, towards a target without forward impedance of the sub projectiles.

It is a yet further object of the present invention to provide a payload of rings which can defeat a target despite comparatively low mass of a given ring as a defeat element.

It is a still further object of the present invention to provide a projectile having a payload of stacked rings which act against a target to cause large holes therein to defeat the target.

It is yet another object of the present invention to provide a projectile which includes a stack of rings enclosed in a multi-pieced sabot.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF FIGURES

Figure 4A:
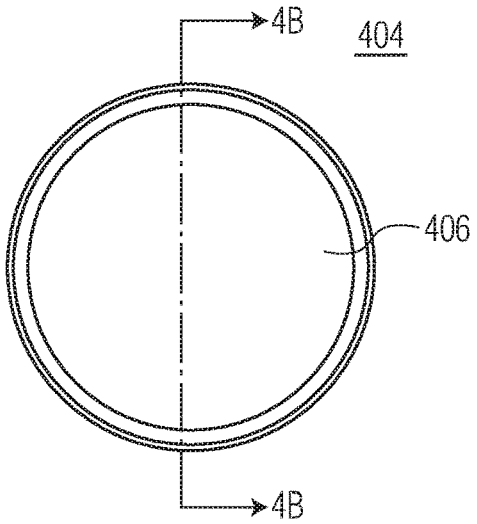
Figure 4B:
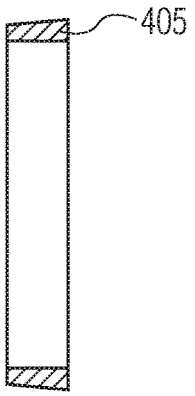

FIG. 4A shows a right view of ring 404 in the projectile 100 when the ring cross sectional trapezoidal shape 405 is used, according to this invention. FIG. 4B shows a cross-sectional view of the ring of FIG. 4A.

Figure 5A:
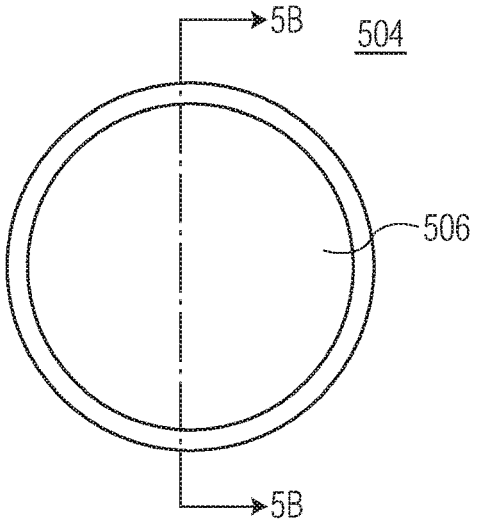
Figure 5B:
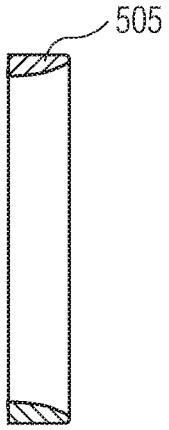

FIG. 5A shows a right view of ring 504 in the projectile 100 when the ring cross sectional shape 505 is used, according to this invention. FIG. 5B shows a cross-sectional view of the ring of FIG. 5A.

Figure 6A:
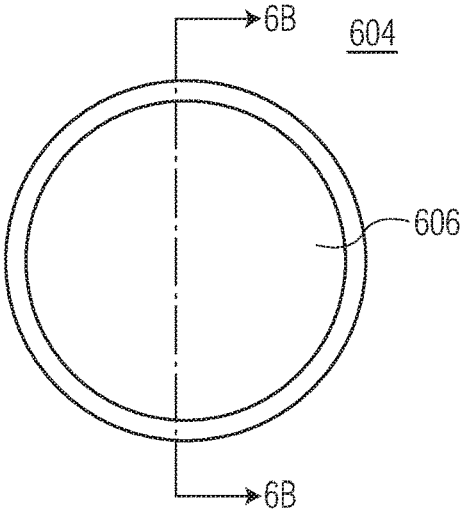
Figure 6B:
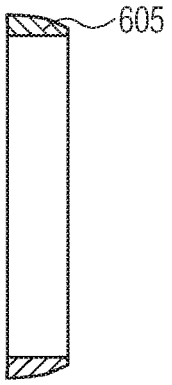

FIG. 6A shows a right view of ring 604 in the projectile 100 when the ring cross sectional shape 605 is used, according to this invention. FIG. 6B shows a cross-sectional view of the ring of FIG. 6A.

Figure 7A:
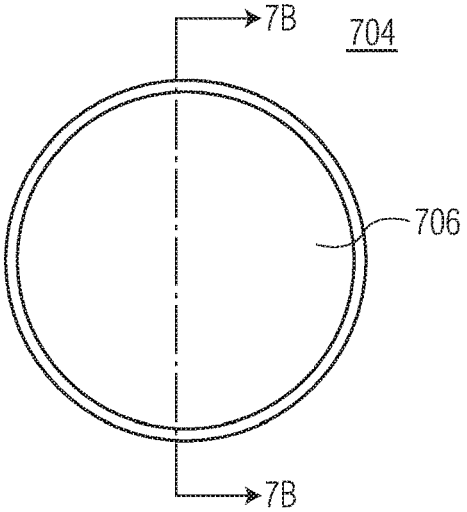
Figure 7B:
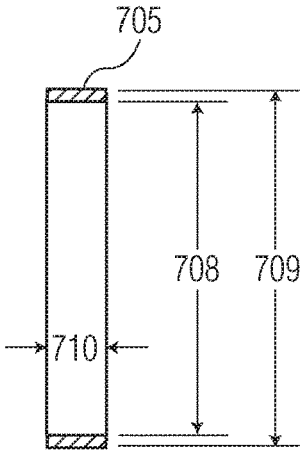

FIG. 7A shows a right view of ring 704 in the projectile 100 when the ring cross sectional rectangular shape 705 is used, according to this invention. FIG. 7B shows a cross-sectional view of the ring of FIG. 7A.

DETAILED DESCRIPTION

Figure 1:
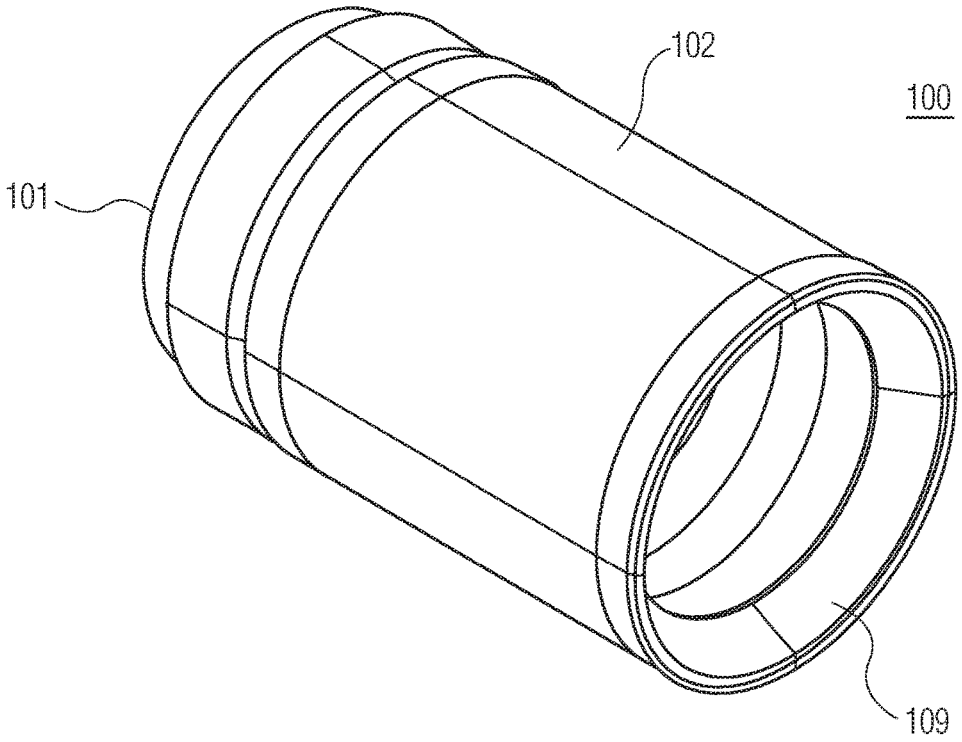
FIG. 1 is a front isometric view of the projectile 100 according to this invention.
Figure 2:
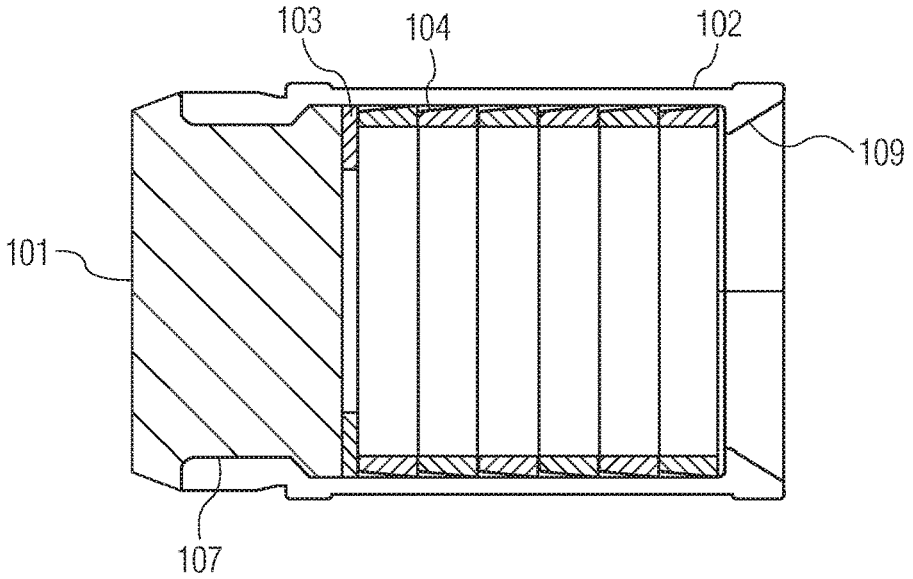
FIG. 2 shows a cross sectional view of the projectile 100 along section lines 2-2 according to this invention.
Figure 3:
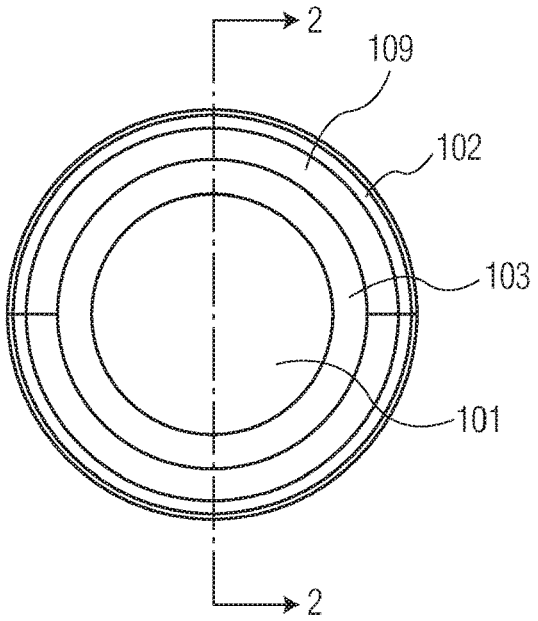
FIG. 3 shows a right view of the projectile 100 according to this invention.

As seen in FIGS. 1 through 3, the sabot sections 102 feature a front rim sufficient to retain the rings and to hold them securely until the assembly exits the barrel. The sabot sections also feature an angled surface 109 that causes them to open as the force of onrushing air hits that surface. This results in the rings being released without any disturbance. Four sabot sections 102 are shown but it may be feasible to have a different number of such sections comprising the sabot. As can be seen in FIGS. 1 through 3, the projectile employs pusher element 101. The pusher is intended to propel the assembly and absorb the majority of the force from the expanding burnt propellant gasses. The pusher also features a groove 107 in which the sabot sections are retained so that the projectile remains together as it travels down the barrel. The assembled sabot sections 102 form a capless sabot. The front of said sabot sections has a lip area 109 to catch onrushing air after launch, to then help discard the sabot sections following muzzle exit. The assembled sabot (open in the front) is formed by the four sabot sections and is used to retain the rings and to provide stability to the round as it travels down the barrel. In the figures shown, the sabots feature a ring at the front and rear of the sabot which allows the sabot to ride the lands of the barrel (if rifled) to reduce the amount of spin imparted to the projectile and rings. The assembled sabot sections 102 also might feature a rotating band (not shown here) to generate spin in order to spin up the rings. The sabots feature a crimp groove which is used to crimp them into a cartridge case in order to retain the sabots before firing. This feature can be removed if the projectile is not crimped into a case and is held together in a different fashion. A flat support ring 103 is used to distribute setback forces of the rings, to avoid causing damage to the pusher during firing. Support ring 103 is only necessary for pusher materials which are unable to support the setback load of the sub projectiles. A ring sub projectile is shown at 104. These ring sub projectiles can feature other various geometries (and materials) as seen in FIGS. 4A through 7B. The rings are stacked inside of sabot sections 102 which form a carrier assembly for these ring sub projectiles. The design can be adjusted to reduce the mass and adjust the geometry of the pusher and sabots. The design can also be adjusted to eliminate the need for the support ring 103. In addition, the sub projectile ring geometry and material can be adjusted in order to change the amount of drag, center of gravity (CG), and mass, of the sub projectile rings. The assembly can also be adjusted to carry more or fewer sub projectile rings per projectile. For example, the cross sectional shapes of the rings may be changed (beyond the types already shown in FIGS. 46-7B); they may be mixed and/or matched in different cross sectional shapes, different thicknesses; some or all the rings may be turned over, oriented in the reverse direction from the cross sectional shape orientations that are currently shown in the Figures, or rings may be made from different materials other than steel or plastics, or mixed and matched, as to materials, thicknesses and orientations for instance. The size of the hole 708 in the rings, relative to ring diameter 709, for instance, or relative to thickness 710 for example, may also be varied.

While the invention may have been described with reference to certain embodiments, numerous changes, alterations and modifications to the described embodiments are possible without departing from the spirit and scope of the invention as defined in the appended claims, and equivalents thereof.

What is claimed is:

1. An unmanned aerial system defeat mechanism being a projectile that is generally cylindrical in shape and which is launched in a gun barrel having a muzzle end, and which projectile includes:

an aft pusher component (101) having a circumferential notch groove (107) therein for receiving and mating with four equal sabot sections (102), said sabot sections enclosing a plurality of rings (104) as sub projectiles that are stacked within said sabot sections forming a payload, the front end of said sabot sections being open and uncapped, and also having a lip (109) thereon for catching onrushing air flow to open said sabot sections after exiting the muzzle end of the barrel to cause said sabot sections to be thereafter discarded, there being also a flat washer support ring element (103) between said aft pusher component (101) and said stack of rings (104) for dispersing set back forces of said stack of rings across the aft pusher component, and whereby the projectile retains its payload while still in the barrel and releases the payload upon muzzle end exit, so as to allow the rings to disperse to cover a large area.

2. The projectile of claim 1 where one or more of the rings has thickness (710) that is wider compared to the other rings.

3. The projectile of claim 1 where the cross sectional shape of each ring (705) is rectangular.

4. The projectile of claim 1 where the cross sectional shape (405) of each ring is trapezoidal.

5. The projectile of claim 1 where the cross sectional shape of each ring (505) has a top surface that is flat but a lower surface that rises parabolically toward a narrower cross sectional height at the right hand edge of said ring.

6. The projectile of claim 1 where the cross sectional shape of each ring (605) has a lower surface that is flat but a top surface that decreases parabolically toward a narrower cross sectional height at the right hand edge of the ring.

7. The projectile of claim 1 where one or more of the rings has of a different cross sectional shape compared to the other rings.

8. The projectile of claim 1 where one or more of the rings is of a different material.

9. The projectile of claim 8 where the material is metal, steel, plastic or composites.

10. The projectile of claim 1 where one or more of the rings is oriented in a reverse direction compared to the other rings.

11. The projectile of claim 1 where the rings have a symmetrical central hole area (708), and where such hole on one or more of the rings is of a different size compared to the other rings.

* * * * *